United States Patent [19]

Faraone

[11] Patent Number: 4,881,617

[45] Date of Patent: Nov. 21, 1989

[54] RADIALLY ARCUATED SPEAKER CONE

[76] Inventor: Alexander Faraone, R.D. #2, Box 75 A, Frenchtown, N.J. 08825

[21] Appl. No.: 292,339

[22] Filed: Dec. 30, 1988

[51] Int. Cl.[4] ..... G10K 13/00

[52] U.S. Cl. ..... 181/164; 181/172; 181/173; 381/202

[58] Field of Search ..... 181/157, 163–165, 181/173, 174, 172; 381/202–204

[56] References Cited

U.S. PATENT DOCUMENTS

| | | | |
|---|---|---|---|
| 1,699,786 | 1/1929 | Goldsborough | 181/173 |
| 1,757,107 | 5/1930 | Baltzley | 181/164 |
| 1,775,294 | 9/1930 | Poroma | 181/164 |
| 1,787,946 | 1/1931 | La Rue | 381/152 |
| 1,917,013 | 7/1933 | Bostwick | 181/164 |
| 2,532,741 | 12/1950 | Stevens . | |
| 2,960,177 | 11/1960 | Hadrthen, Jr. | 181/164 |
| 3,364,315 | 1/1968 | Gorike | 381/203 |
| 3,581,015 | 5/1971 | Masuda | 381/155 |
| 4,013,846 | 3/1977 | Krawczak et al. | 181/174 X |
| 4,300,655 | 11/1981 | Sakamoto et al. | 181/167 |

*Primary Examiner*—B. R. Fuller

*Attorney, Agent, or Firm*—Kenneth P. Glynn

[57] ABSTRACT

The present invention is directed to an improved acoustic speaker having a cone located about a transducer wherein the cone has a plurality a thin, pie-shaped segments radiating outwardly from the transducer with each of the segments having an accuated cross-section, thereby creating a concave side and a convex side. The segments are highly concave at the transducer and less concave with increasing radial distance from the transducer. The segments are made from a metal foil and the width of the segments may increase lineraly with radial distance so as to create a constant acoustical resistance radially. The segments preferably terminate at a flexible, high sound absorption ring.

10 Claims, 3 Drawing Sheets

RADIALLY ARCUATED SPEAKER CONE

BACKGROUND OF THE INVENTION

1. Field Of The Invention

The present invention relates to acoustic speakers and particularly to such speakers which have cones with arcuated segments which extend radially. Thus, the present invention is directed to the pursuit of constant wave velocity generation for accurate sound reproduction utilizing three dimensionally defined cones.

2. Prior Art Statement

The function of cones in speakers is well known and it has been accepted that a coil generates sound waves radially over a speaker cone, typically made of material capable of vibration when properly mounted. The cones were originally named as such due to the slightly "conical" configuration.

Early speaker designs are explified by U.S. Pat. No. 1,787,946 to LaRue wherein a suspended diaphragm is used. However, conventional acoustic speakers involved diaphragms of the aforesaid basic conical design wherein it radiated outwardly about a coil. Subsequent improvements led to the acoustic diaphragm having a honeycomb cone, e.g. of a plurality of laminated metal foils, the adjacent metal foils being adhered at a regular pitch. U.S. Pat. No. 4,300,655 to Sakamoto et al describes an acoustical diaphragm which is made of a cone member of elongated web material bent to have a plurality of radial projections sandwiched between upper and lower flat components. It is indicated by the invention therein that increased speaker power is achieved due to model line reshaping. While this patent is concerned with radial sound wave generation it is not directed to the type of system represented by the present invention wherein constant wave velocities are sought utilizing arcuated speaker segments which tend towards flattening as the radial distance increases.

SUMMARY OF THE INVENTION

The present invention is directed to an improved acoustic speaker having a cone located about a transducer wherein the cone has a plurality of thin, pie-shaped segments radiating outwardly from the transducer with each of the segments having an arcuated cross-section, thereby creating a concave side and a convex side. The segments are highly concave at the transducer and less concave with increasing radial distance from the transducer. The segments are made from a metal foil and the width of the segments may increase linearly with radial distance so as to create a constant acoustical resistance radially. The segments preferably terminate at a flexible, high sound absorption ring.

BRIEF DESCRIPTION OF THE DRAWINGS

The present invention is more fully understood when the specification herein is taken in conjunction with the drawings attached, wherein.

DETAILED DESCRIPTION OF THE INVENTION

Figure 1:
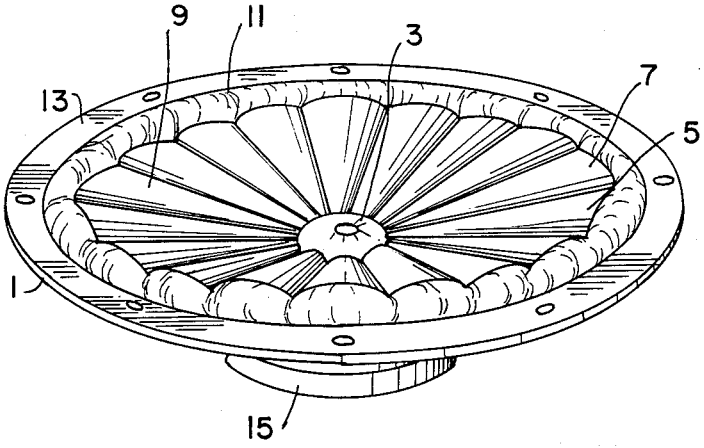
FIG. 1 is a oblique front view of a speaker of the present invention.

As mentioned in discussing the prior art above, conventional speakers utilize flat or honeycombed cones. These speakers experience variable velocities of waves during wave propagation which create distortion of the emitting sound. The present invention, however, is directed to attempting to achieve constant wave velocity through specifically defined cones. The particular cones utilized in the present invention have segments which create constant mass density for wave generation with minimal distortion, constant wave velocity and, thus, constant acoustical resistance.

Although the present invention is physically defined herein and is, therefore, not limited by any specific theory of operation, the theory upon which the present invention is based, is believed to be as follows:

The constant wave velocity cone acoustic speaker is an accurate sound reproducing device utilizing a dynamic voice coil assembly to drive a three dimensional conical diaphragm. The three dimensional cone diaphragm for this speaker has been developed through analytical and mathematical study of electromechanical wave propagation as produced by cone type diaphragms to reproduce sound in air.

The theory in design of the constant velocity cone loudspeaker is to achieve by mathematical formulation the correct geometry of the cone diaphragm as to satisfy all parameters needed for proper mechanical wave propagation in the cone diaphragm and as reproduced in air. Through this formulation it is also possible to accurately predict the loudspeaker's sound reproducing process before the loudspeaker is fabricated.

The formulated geometrical shape of the diaphragm is actually a mechanical and acoustical equivalent to the formation of a wave cycle as produced in an electronic wave transmission line such as coaxial cable used in R.F. wave distribution. The formulations are very similar to ones used in antenna design.

The conical diaphragm is circular in shape and is divided into equal pie shaped segments. Each segment has a convex and concave side with convex side facing listener. All segments are arranged in a circular pattern with smaller end of pie shaped segment attached to voice coil or transducer support.

Preferrably the outer end of the segments are terminated to a flexible high sound absorption suspension ring. The segmented diaphragm or cone may be constructed from one piece of very thin and lightweight sheet of material such as two mill thick tempered (hard) aluminum, or may be formed by annealing or heat sealing a plurality of individually formed segments. In one method, from one piece of material each segment is formed into arches (arcuated) and into its conical pie shape. The fold between each arcuated segment serves as a rigid support between each adjacent segments convex side and also as a wave termination point.

Each fold as viewed from front of speaker is much deeper near voice coil and is decreasing as radially outwardly towards the suspension ring. The greater concave portion, i.e. more arcuated portion near the voice coil support serves as rigid support at driven end of the segments and as an extension of the voice coil or transducer support.

Each segment serves as a half wave acoustical radiator. Together with its 180° adjacent counter part, each segment serves as a full wave acoustical radiator or dipole radiator. The cone or diaphragm consisting of a number of acoustical dipole radiators, is divided ideally into an even number of segments.

Each segment starting at the smaller driven end with circumference increasing on its radial axis outwardly to the suspension ring responds in phase with, and throughout its electrical input, the wave cycle or cycles as reproduced by voice coil. Individual portions of each segment respond to specific parts of the wave cycle or cycles.

The radial axis responds to wave length of cycle or cycles. The slant sides of segment starting at fold responds to beginning formation of cycle rising to a starting point of highest current. Increasing circumference of each segment responds to a point of highest current equal to $1/\pi$ of wavelength of the cycle or cycles.

This segment response is the same for both positive and negative halves of the wave cycle or cycles. In a preferred embodiment, a small, high frequency reinforcing diaphragm is used to cover the voice coil support and serves as a dust cover, and is very useful in increasing high frequency wave dispersion. Although its not an integral part of the present invention cone for speakers with voice coil or transducer, and is generally used for coils of diameters atleast one inch or more, it is considered as important part of the speaker for larger voice diameters to optimize the invention. This smaller diaphragm or cone may be designed the same as the main cone, except that the larger circumference of the cone should be terminated to a voice coil support and smaller or central end should be terminated by a small piece of flexible sound absorbing material and its radius phase angle convex.

In the cone with the arcuated segments, the cone mass and cone surface area within the cone area is calculated for a mechanical wave cycle or cycles beginning at the circumference on edge of the voice coil or transducer support, traveling on a radius cone axis at all points 360° to its outer circumference so as to encounter equal mass throughout its complete wave cycle or cycles. This is referred to as constant acoustical resistance, a measurement expressed in grams per second per square centimeters. The mechanical wave cycle in the cone, is thus a function of its particle velocity. Particle velocity is defined as follows:

The particle velocity in a sound wave is the instantaneous velocity of a given infinitesimal part of the medium with reference to the medium as a whole, due to the passage of sound. With reference to the medium as a whole in this case, it is the cone mass and surface area within the specific cone area. The end result for this calculated mechanical wave propagation in the cone is a constant wave velocity diaphragm, or cone. Since the electrical wave cycle has a constant velocity, so must the diaphragm to enable it to reproduce any kind of complex wave form or forms in air. Since the voice coil is the electrical transducer reproducing the mechanical wave cycle in the cone it must be considered as a part of the cone with a mass equal to $1/\pi$ of the total diaphragm mass measured in grams.

The relationship created by the voice coil mass equaling $1/\pi$ of the total diaphragm mass results in equal mechanical impedances exhibiting maximum efficiencies at high frequencies. Expressed differently, the mass of the cone is equal to $\pi$ multiplied by the mass of the voice coil or transducer.

Looking at conventional cone design, it is found that the function of constant wave velocity does not exist at all frequencies. This is confirmed by calculating the rate of mass encountered by mechanical sound wave traveling on a radius axis 360° at all points in a flat sound diaphragm. By dividing the cone circle into imaginary radiating rings with the smaller ring near the driven end and with rings increasing in diameters to the outer circumference of the cone, it is discovered that the mechanical wave traveling outwardly through all points 360° will encounter an increasing growth of mass. In one case this was found to be equal to 6.28 gram increasing each time it passed through a series of sequential rings. Thus, the mechanical velocity of the wave cycle is being slowed down or delayed by the increase of mass encountered. This delay prevents the mechanical wave cycle from being in phase with its electrical input wave cycle and further distorts phase response of wave cycle produced in air. The delayed wave cycle in air prevents the particles of sound information to arrive at the listener's ear at the same time.

This example is simplified for clarity, since some conventional cone diaphragms may not be flat but rather concave with its mechanical wave traveling on its slant radius axis. For cone diaphragms of different angles the increase of mass may be more or less but not equal or constant as in the present invention.

Another problem caused by the delay of the mechanical wave cycle in conventional cones is the collision of mechanical waves. In a wave train of cycles, a mechanical wave may not be totally absorbed by the suspension ring and reflect back into the oncoming train of waves causing standing waves on the cone. Another cause of this problem is the slower wave at the larger end of cone will modulate the oncoming train of waves distorting them and producing frequencies not related to the program source.

Another problem with the coventional cones is the effect it has on the impedance of the voice coil. The mass of the cone at the driven end is smaller than mass of the coil and than the mass at the undriven end cone. At frequencies with a wavelength falling into area of cone which has a mass less than the voice coil, the cone cannot completely overcome the inertia of the driving voice coil. As the frequency increases and wavelength decreases, the inertia of the voice coil becomes more and more difficult to overcome. This results in an increase in voice coil impedance. At this point, the amplifier sees a higher resistance load increasing with frequency. This results in less power delivered at higher frequencies causing poor efficiency and response, inacurate formation of beginning wave cycles of fundamental frequency and/or poor transient response.

The geometry for the present invention constant velocity speaker is calculated to satisfy all of the above parameters to overcome deficiencies which may occur in conventional cone loudspeakers. Thus, the qualities exhibited by this present invention speaker, confirmed through electronic and listening testing, are:

1. smooth frequency response;
2. accurate phase response;
3. constant impedance;
4. constant wave velocity;
5. accurate transient response;
6. increased efficiency;
7. wide sound dispersion;

8. increased power handling;
9. very low harmonic distortion;
10. wide frequency response range;
11. 6 db increase in sound at nearly all frequencies using two parallel operated speakers; and,
12. high degree of definition and clarity.

In many embodiments, the present invention speaker may be used as a full range single cone operation, thereby omitting the need for costly crossover networks.

Referring now more specifically to the drawings, there is shown speaker 1 in FIG. 1 in its oblique front view. Coil 3 has a conventional voice coil and transducer capabilities and includes standard wiring and central frame 15. Thin, pie-shaped segments exemplified by segments 5, 7, and 9 radiate outwardly from coil 3 and terminate at flexible, high sound absorption ring 11 held in place by metal ring 13.

Figure 2:
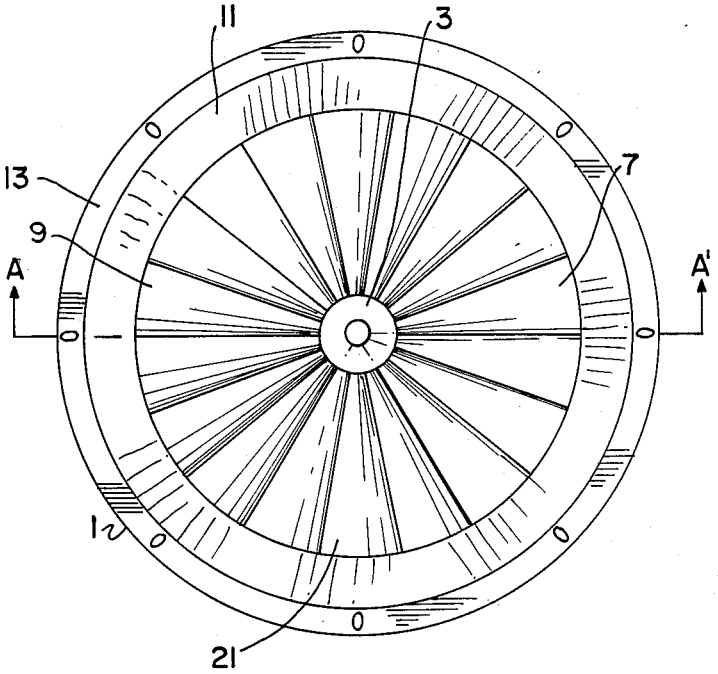
FIG. 2 is a frontal plan view of the speaker of FIG. 1.
Figure 3:
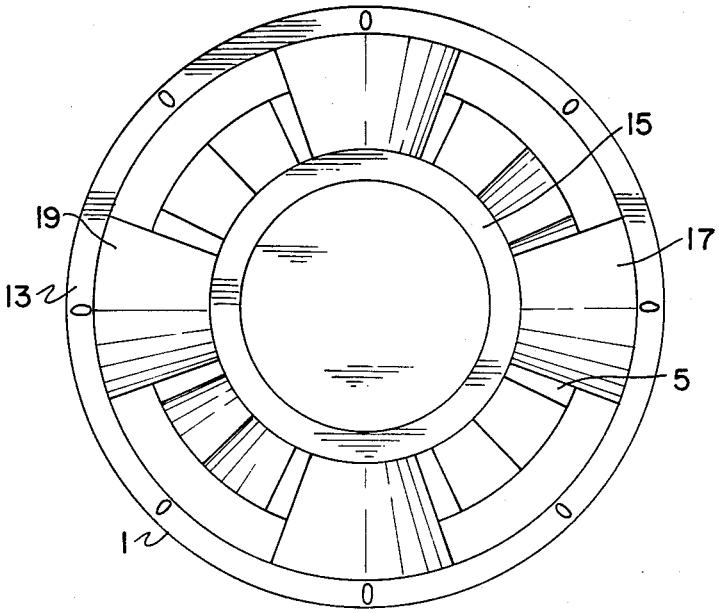
FIG. 3 is a rear plan view of the speaker of FIG. 1.
Figure 4:
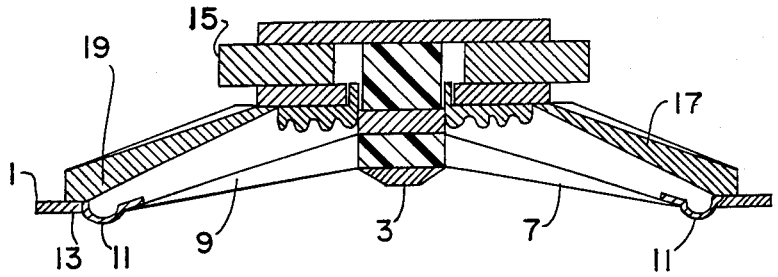
FIG. 4 is a cut top view of the speaker of FIG. 2 along line AA'.

FIG. 2 shows a top view of speaker 1 and FIG. 3 shows a bottom view of speaker 1. Like parts are like numbered throughout. Cut line AA' through speaker 1 in FIG. 2 is the cut line for the cut side view of speaker 1 as shown in FIG. 4. As shown in FIGS. 3 and 4 brackets exemplified by brackets 17 and 19 connect metal ring 13 to central frame 15.

Figure 5:
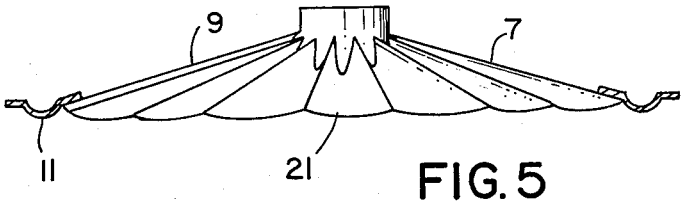
FIG. 5 is a side plan view of a cone and transducer coil from the present invention speaker shown in FIGS. 1–4.

Referring now to FIG. 5, there is shown a stripped down side view of a present invention speaker with brackets and frames removed and with flexible, high sound absorption ring 11 cut, turned upside down to show that each of the segments such as segment 21 is arcuated. Moreover, as segment 21 reveals, it has a highly concave cross-section at the coil or transducer, with a lessening concave cross-section with increasing radial distance from the coil. As in this example, the width of the segments increases linearly with increasing radial distance from the transducer so as to create constant acoustical resistance radially. Also, while the segments are in this example made of metal foil, they may alternatively be made of another metal or alloy or of plastic, fiberglass or cellulosic material. Additionally, an even number of segments is preferred so that half wave cycles are accomadated with an even number of segments.

Figure 6:
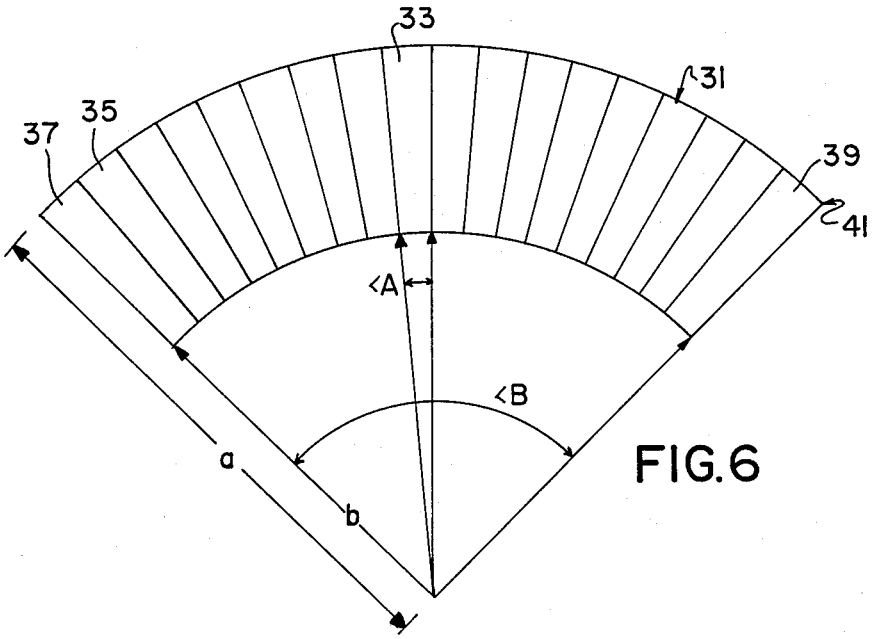
FIGS. 6, 7, and 8 illustrate a construction technique for making the cone of the present invention speakers.
Figure 7:
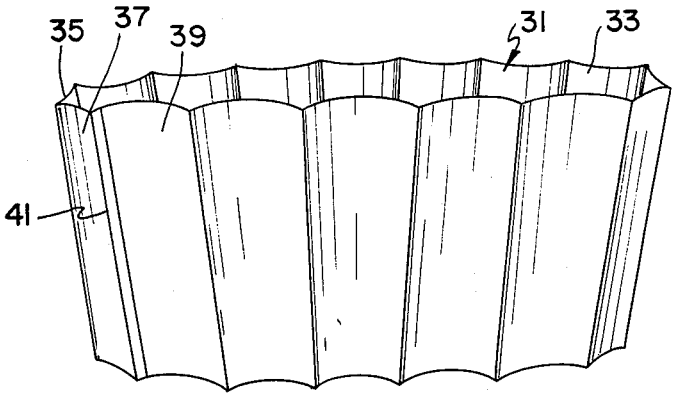
Figure 8:
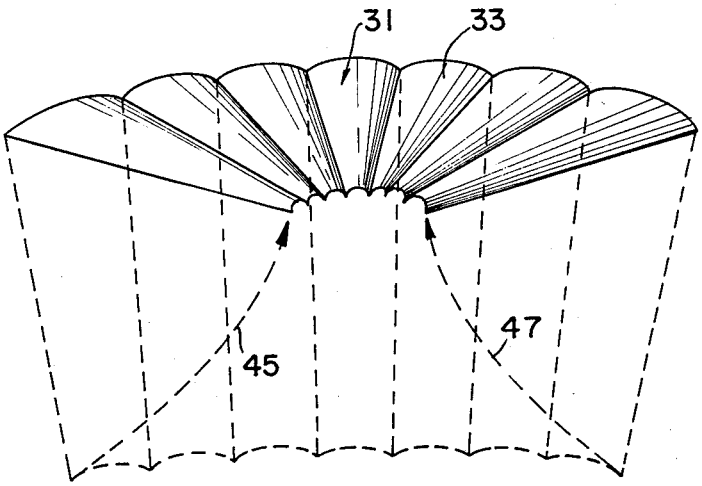

FIGS. 6, 7, and 8 illustrate one method of preparing a present invention. In FIG. 6, foil 31 is shown in its strip configuration with individual segments represented by segments 33, 35, 37, and 39. At the end of segment 39 is seam end 41 for subsequent attachment to the unconnected end of segment 37. Distance "a" represents the outer radius and "b" represents the inner radius. As shown, the outer cone circumference itself, would be equal to the distance of foil 31 at its outer radius from the outer end of segment 37 to the outer end of segment 39. The individual segments are arcuated and in preferred embodiments began as rectangular pieces and thus have clearly mathematically defined arcs which are highly concave at the inner radius "b" and least concave at the outer radius "a". As shown by angles A and B, each segment as well as the entire foil has increasing width with increasing radius. The seam end 41 is adhered to the opposite end of segment 37 as shown in FIG. 7 to form a basket-like ring of continuous foil. The foil is next formed into its true conical shape by folding the bottoms of the segments as shown in FIG. 7 upwardly and inwardly as indicated by arrows 45 and 47 so as to create the desired cone configuration as shown by the partial cut view of FIGS. 8 and installed over a voice coil such as is shown in FIG. 1.

Obviously, numerous modifications and variations of the present invention are possible in light of the above teachings. It is therefore understood that within the scope of the appended claims, the invention may be practiced otherwise than as specifically described herein. For example while the speakers described herein are circular , the conical segments may be cut so as to create rectangular, oval, hexagonal or other configurations with out exceeding the scope of the present invention.

What is claimed is:

1. In an acoustic speaker having a center, having a transducer located at said center and having a cone for conversion of electromechanical energy to sound located about said transducer, the improvement which comprises:

a cone having a plurality of thin, pie shaped segments which radiate outwardly from said transducer, each of said segments having an arcuated cross-section, thereby creating a concave side and a convex side to each such segment, all of said concave sides of said segments facing one direction and all of said convex sides of said segments facing an opposite direction, and further wherein said arcuated segments have a highly concave cross section at the transducer and a less concave cross-section with increasing radial distance from the center of the speaker.

2. The acoustic speaker of claim 1 wherein said thin, pie shaped segments are made of a metal foil.

3. The acoustic speaker of claim 1 wherein the arcuated segments have a lessening concaveness with increasing radial distance from the center of the speaker whereby a width of the segment increases linearly with increasing radial distance so as to create constant acoustical resistance radially.

4. The acoustic speaker of claim 1 wherein said segments terminate at a flexible, high sound absorption suspension ring.

5. The acoustic speaker of claim 1 wherein said speaker may be used for vertical mounting and all segments have the convex surface facing outwardly.

6. The acoustic speaker of claim 4 wherein said speaker may be used for vertical mounting and all segments have the convex surface facing outwardly.

7. The acoustic speaker of claim 1 wherein a mass of the cone is about $\pi$ multiplied by a mass of the transducer.

8. The acoustic speaker of claim 3 wherein a mass of the cone is about $\pi$ multiplied by a mass of the transducer.

9. The acoustic speaker of claim 5 wherein a mass of the cone is about $\pi$ multiplied by a mass of the transducer.

10. The acoustic speaker of claim 6 wherein a mass of the cone is about $\pi$ multiplied by a mass of the transducer.

* * * * *